US007650101B2

(12) United States Patent
Hosokawa et al.

(10) Patent No.: US 7,650,101 B2
(45) Date of Patent: Jan. 19, 2010

(54) IMAGE FORMING APPARATUS CAPABLE OF EFFECTIVELY DEVELOPING IMAGES

(75) Inventors: Hiroshi Hosokawa, Kanagawa-ken (JP); Kenichirou Nagai, Kanagawa-ken (JP)

(73) Assignee: Ricoh Co., Ltd., Tokyo (JP)

( * ) Notice: Subject to any disclaimer, the term of this patent is extended or adjusted under 35 U.S.C. 154(b) by 209 days.

(21) Appl. No.: 11/287,305

(22) Filed: Nov. 28, 2005

(65) Prior Publication Data

US 2006/0115302 A1 Jun. 1, 2006

(30) Foreign Application Priority Data

Nov. 26, 2004 (JP) ..... 2004-341895
Aug. 31, 2005 (JP) ..... 2005-250836

(51) Int. Cl.
*G03G 15/08* (2006.01)

(52) U.S. Cl. ..... 399/254

(58) Field of Classification Search ..... 399/254
See application file for complete search history.

(56) References Cited

U.S. PATENT DOCUMENTS 3,664,299 A * 5/1972 Shaler et al. ..... 399/256
5,486,909 A 1/1996 Takenaka et al.
5,489,747 A 2/1996 Takenaka et al.
5,552,870 A 9/1996 Murakami et al.
5,617,191 A 4/1997 Murakami et al.
5,625,438 A 4/1997 Sugiyama et al.
5,625,440 A 4/1997 Matsumae et al.
5,625,441 A 4/1997 Sugiyama et al.
5,627,630 A 5/1997 Matsumae et al.
5,666,625 A 9/1997 Komatsubara et al.
5,689,782 A 11/1997 Murakami et al.
5,697,026 A 12/1997 Matsumae et al.

(Continued)

FOREIGN PATENT DOCUMENTS

JP 10-207201 8/1998

(Continued)

OTHER PUBLICATIONS

Translation of Baba (JP 10-207201).*

(Continued)

*Primary Examiner*—David M Gray
*Assistant Examiner*—Erika Villaluna
(74) *Attorney, Agent, or Firm*—Oblon, Spivak, McClelland, Maier & Neustadt, P.C.

(57) ABSTRACT

An image forming apparatus, a process cartridge, and a developing unit includes a developer carrying member to carry developer, first and second rotary members arranged in parallel to each other and configured to rotate to agitate and convey the developer, and an enclosure having an inside space to contain the developer, the inside space being divided by a partition with communication openings formed therein at opposite ends thereof into a first chamber configured to maintain the developer above a first level and to hold the first rotary member therein which supplies the developer to the developer carrying member while agitating and conveying the developer, and a second chamber configured to communicate with the first chamber through the communication openings, to maintain the developer at a second level lower than the first level, and to hold the second rotary member therein which circulates the developer with the first chamber through the communication openings.

17 Claims, 10 Drawing Sheets

U.S. PATENT DOCUMENTS

| | | | |
|---|---|---|---|
| 5,708,942 | A | 1/1998 | Sugiyama et al. |
| 5,768,665 | A | 6/1998 | Yamanaka et al. |
| 5,819,145 | A | 10/1998 | Tanaka et al. |
| 5,826,144 | A | 10/1998 | Takenaka et al. |
| 5,845,183 | A | 12/1998 | Sugiyama et al. |
| 5,879,752 | A | 3/1999 | Murakami et al. |
| 6,033,818 | A | 3/2000 | Sugiyama et al. |
| 6,560,431 | B2 | 5/2003 | Hosokawa |
| 2004/0096239 | A1 | 5/2004 | Hosokawa et al. |
| 2004/0170446 | A1 | 9/2004 | Nagashima et al. |
| 2004/0170447 | A1 | 9/2004 | Arai et al. |
| 2004/0184841 | A1 | 9/2004 | Tsuda et al. |
| 2004/0223782 | A1 | 11/2004 | Hosokawa et al. |
| 2004/0223790 | A1 | 11/2004 | Hosokawa et al. |
| 2005/0158071 | A1 | 7/2005 | Hosokawa et al. |
| 2005/0226656 | A1 | 10/2005 | Tsuda et al. |
| 2005/0238384 | A1 | 10/2005 | Sampe et al. |

FOREIGN PATENT DOCUMENTS

| | | |
|---|---|---|
| JP | 11-119529 | 4/1999 |

OTHER PUBLICATIONS

U.S. Appl. No. 11/736,881, filed Apr. 18, 2007, Hosokawa, et al.

* cited by examiner

IMAGE FORMING APPARATUS CAPABLE OF EFFECTIVELY DEVELOPING IMAGES

BACKGROUND

1. Technical Field

This specification generally describes an apparatus for image forming, and more particularly describes an apparatus for image forming capable of effectively developing images.

2. Discussion of the Background

There is a widely known image forming apparatus having a developing unit including two conveyance screws and a development roller disposed above one of the two conveyance screws.

FIG. 1 is a cross-sectional view of a background developing unit 5 used in a background image forming apparatus. The developing unit 5 includes a first screw 55, a second screw 56, and a development roller 51 disposed above the first screw 55. FIG. 2 is a perspective view of the first screw 55 and the second screw 56. FIG. 3 illustrates another aspect of the background developing unit 5 of FIG. 1.

Referring to FIG. 1, the developing unit 5 further includes a developer-containing portion divided by a partition into a first chamber 53 and a second chamber 54. The first chamber 53 is provided with the first screw 55, and the second chamber 54 is provided with the second screw 56. Developer dispensed into the second chamber 54 from above may be agitated and conveyed by the second screw 56 to the first chamber 53. Part of the developer in the first chamber 53 is to be picked up by the development roller 51.

Referring to FIG. 2, the first screw 55 and the second screw 56 have a substantially equal shape, volume, and conveying speed. That is, the first screw 55 and the second screw 56 convey a substantially equal amount of developer per time unit. The first chamber 53 and second chamber 54 have a substantially equal volume. Therefore, a surface of the developer in the first chamber 53 and a surface of the developer in the second chamber 54 may be at a substantially equal height.

As illustrated in FIG. 1, when the first chamber 55 is filled with the developer, the second chamber 54 is also filled with the developer. When the second screw 56 in the second chamber 54 is buried in the developer, an upper portion of the developer may not be sufficiently agitated by the second screw 56. In other words, the developer may not be sufficiently charged. Those skilled in the art may appreciate that the use of insufficiently charged toner for development may cause drawbacks such as background contamination and a toner spatter.

On the other hand, as illustrated in FIG. 3, when the second chamber 54 has a relatively low level of developer, the first chamber 53 also has a relatively low level of developer. When the first chamber 53 has a relatively low developer, the height of the surface of the developer may vary before and after movement of a blade portion of the first screw 55Y. As a result, an amount of the developer picked up by the development roller 51Y may be unstable, and an abnormal image referred to as a conveyance-screw-pitch irregularity may be caused. When any rotary member for conveying developer by rotation is used instead of the screws, there is a possibility that a similar kind of abnormal image is caused.

SUMMARY

An image forming apparatus, a process cartridge, and a developing unit includes a developer carrying member to carry developer, first and second rotary members arranged in parallel to each other and configured to rotate to agitate and convey the developer, and an enclosure having an inside space to contain the developer, the inside space being divided by a partition with communication openings at opposite ends thereof into a first chamber configured to maintain the developer above a first level and to hold the first rotary member therein which supplies the developer to the developer carrying member while agitating and conveying the developer, and a second chamber configured to communicate with the first chamber through the communication openings, to maintain the developer at a second level lower than the first level, and to hold the second rotary member therein which circulates the developer with the first chamber through the communication openings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
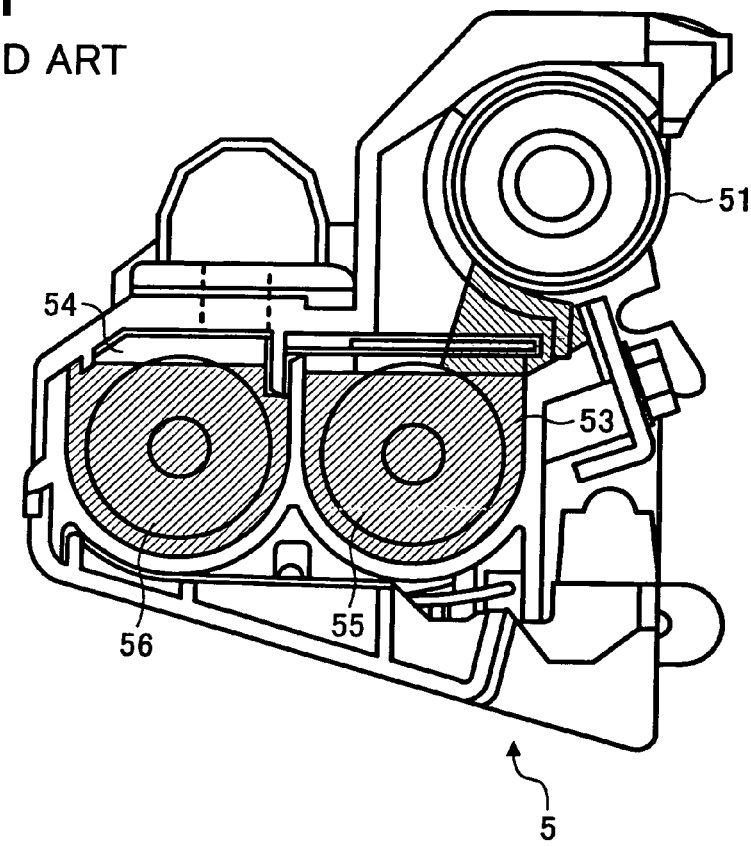
FIG. 1 BACKGROUND ART
FIG. 1 is a cross-sectional view of a developing unit of a background image forming apparatus in a state where both of a first chamber and a second chamber are filled with developer.
Figure 2:
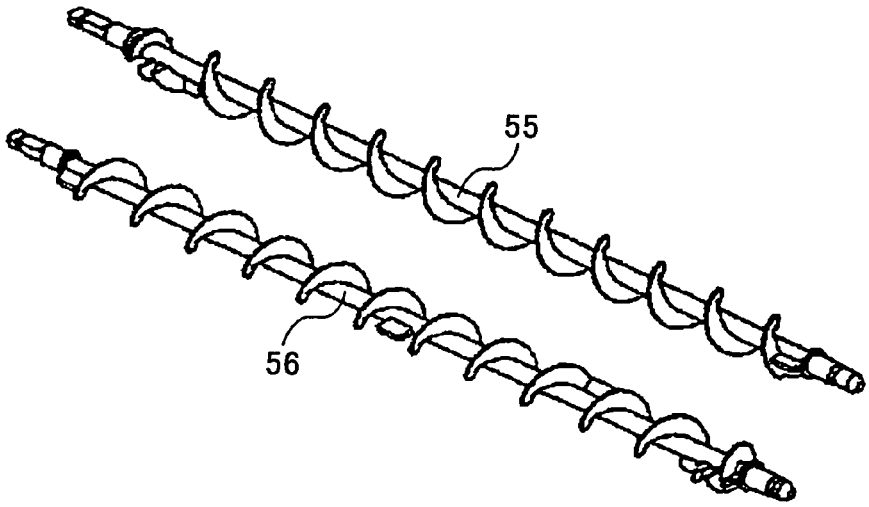
FIG. 2 BACKGROUND ART
FIG. 2 is a perspective view of a first screw and a second screw used in the developing unit of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 4:
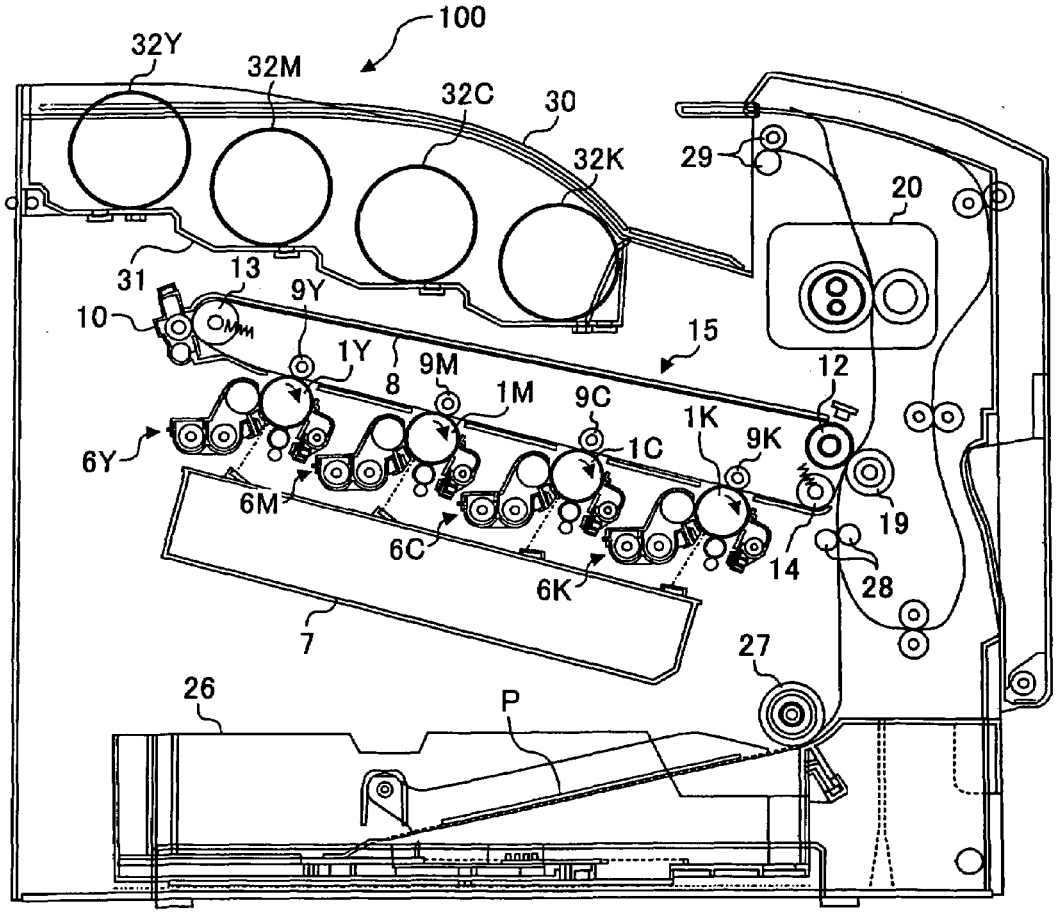
FIG. 4 is a schematic diagram of an example image forming apparatus according to an example embodiment.

Referring now to the drawings, wherein like reference numerals designate identical or corresponding parts throughout the several views, particularly to FIG. 4, an image forming apparatus 100 according to an example embodiment is described.

As illustrated in FIG. 4, the image forming apparatus 100 includes four process cartridges 6Y (yellow), 6M (magenta), 6C (cyan), and 6K (black), an exposure unit 7, an intermediate image transfer unit 15, a secondary transfer roller 19, a fixing unit 20, a sheet cassette 26, a feed roller 27, a registration roller pair 28, an output roller pair 29, a stacking portion 30, and a bottle container 31. The intermediate image transfer unit 15 includes an intermediate image transfer belt (simply belt hereinafter) 8 as an intermediate image transfer body being stretched and endlessly moved.

The four process cartridges 6Y, 6M, 6C, and 6K for forming toner images of yellow, magenta, cyan, and black, respectively, have substantially similar configurations except that toner of different colors are used as image forming materials. The process cartridges 6Y, 6M, 6C, and 6K can be replaced when reaching their end of life. In addition, the process cartridges 6Y, 6M, 6C, and 6K are detachable from the image forming apparatus 100 so that consumable parts may be replaced at a time. In this specification, the process cartridge 6Y for forming a yellow toner image will be described as a representative example for purposes of explanation.

Figure 5:
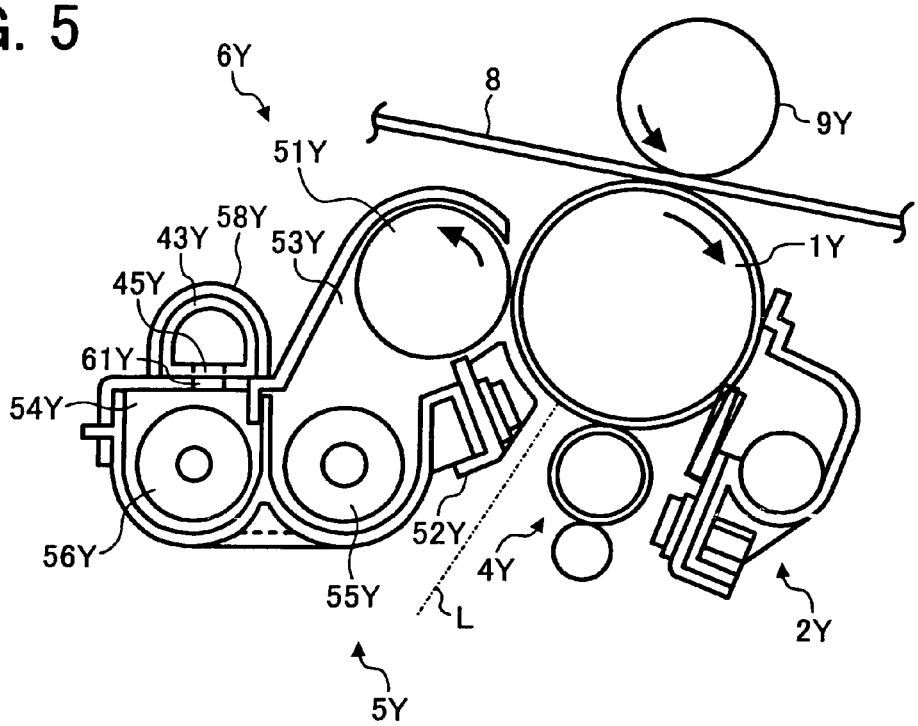
FIG. 5 is an enlarged sectional view of a process cartridge of the image forming apparatus of FIG. 4.

As illustrated in FIG. 5, the process cartridge 6Y includes a photoconductive member 1Y serving as a drum-type image carrier, a drum cleaner unit 2Y, a charger unit 4Y, and a developing unit 5Y.

The charger unit 4Y uniformly charges a surface of the photoconductive member 1Y rotated clockwise as viewed in FIG. 5 by a driving device. When the uniformly charged surface of the photoconductive member 1Y is scanned by, that is, exposed to a laser beam L, the photoconductive member 1Y carries a latent image. The developing unit 5Y develops the latent image into a yellow toner image using yellow toner. Then, the yellow toner image is transferred onto the belt 8, which operation is referred to an intermediate image transfer. The drum cleaner unit 2Y cleans the surface of the photoconductive member 1Y by removing toner remaining after the intermediate image transfer. Charges remaining on the surface of the photoconductive member 1Y after the cleaning may be discharged by a discharger unit (not shown), so that the surface of the photoconductive member 1Y is initialized so as to be ready for the next image formation.

In the other process cartridges 6M, 6C, and 6K, toner images of magenta, cyan, and black are formed and are transferred onto the intermediate image transfer belt 8 in a similar manner.

Under the process cartridges 6Y, 6M, 6C, and 6K as viewed in FIG. 4, there is disposed the exposure unit 7. The exposure unit 7 includes a light source (not shown) emitting the laser beam L to irradiate each photoconductive member of the process cartridges 6Y, 6M, 6C, and 6K according to image information of yellow, magenta, cyan, and black, respectively. In the exposure unit 7, for each color, the laser beam L is generated by the light source thereof and is reflected and adjusted by a polygon shaped mirror, rotationally driven by a motor, and a plurality of optical lenses and mirrors to scan the corresponding photoconductive member. According to the exposure, latent images of yellow, magenta, cyan, and black are formed on the photoconductive members 1Y, 1M, 1C, and 1K, respectively.

A sheet feeding system includes the sheet cassette 26, the feed roller 27, and the registration roller pair 28. Here, a plurality of sheet cassettes 26 may be provided. The sheet cassette 26 is loaded with a stack of sheets P of transfer paper as a recording medium, and a top sheet of the sheets P (i.e. the sheet P) in the sheet cassette 26 is in contact with the feed roller 27. The feed roller 27 is rotated counterclockwise as viewed in FIG. 4 to transport the sheet P toward the registration roller pair 28. Both rollers of the registration roller pair 28 are rotationally driven to hold the sheet P. Immediately after holding the sheet P, the registration roller pair 28 temporarily stops rotating. Then with suitable timing in synchronism with transfer of the image on the belt 8, the registration roller pair 28 sends the sheet P toward the secondary transfer roller 19.

Above the process cartridges 6Y, 6M, 6C, and 6K, the intermediate image transfer unit 15 is disposed. In addition to the belt 8, the intermediate image transfer unit 15 includes four primary transfer bias rollers 9Y, 9M, 9C, and 9K and a cleaning unit 10.

The intermediate image transfer unit 15 further includes a secondary transfer backup roller 12, a cleaning backup roller 13, and a tension roller 14. The belt 8 is stretched across the three rollers forming a loop and is endlessly moved counterclockwise as viewed in FIG. 4 by at least one of the rollers rotationally driven. The endlessly moved belt 8 is held between the primary transfer bias rollers 9Y, 9M, 9C, and 9K and the photoconductive members 1Y, 1M, 1C, and 1K, respectively, to form respective nips for a primary image transfer. Each of the primary transfer bias rollers 9Y, 9M, 9C, and 9K applies a transfer bias having an opposite polarity (e.g. a positive polarity) from the polarity of the toner to a back side (i.e. an inside of the loop) of the belt 8. All rollers other than the primary transfer bias rollers 9Y, 9M, 9C, and 9K are electrically grounded.

While the belt 8 is endlessly moved, the belt 8 sequentially passes through the nips for the primary image transfer for yellow, magenta, cyan, and black so that toner images of yellow, magenta, cyan, and black on the photoconductive members 1Y, 1M, 1C, and 1K are sequentially transferred to the belt 8 in a superposed manner, which operation is referred to as a primary image transfer. Thus, a four- or multi-color toner image, hereinafter referred to as a multi-color toner image, is created.

The secondary transfer backup roller 12 and the secondary transfer roller 19 hold the belt 8 therebetween to form a nip for a secondary image transfer. At the nip for the secondary image transfer, the multi-color toner image formed on the belt 8 is transferred onto the sheet P, which operation is referred to as the secondary image transfer. Toner remaining on the belt 8 after passing through the nip for the secondary image transfer is cleaned by the cleaning unit 10.

At the nip for the secondary image transfer, the sheet P is held between the belt 8 and the secondary transfer roller 19, both of which surfaces are moved in a forward direction. As a result, the sheet P is transported by the nip for the secondary image transfer toward the fixing unit 20.

When the sheet P passes between rollers of the fixing unit 20, the transferred multi-color toner image on a surface of the sheet P is fixed with heat and pressure. Thereafter, the sheet P is sent out of the apparatus through rollers of the output roller pair 29 onto the stacking portion 30 formed on an external top of the image forming apparatus 100. The sheet P is sequentially stacked on the stacking portion 30.

The bottle container 31 is disposed between the intermediate image transfer unit 15 and the stacking portion 30. The bottle container 31 houses toner bottles 32Y, 32M, 32C, and 32K as developer containers for containing toner of yellow, magenta, cyan, and black, respectively. Toner bottles 32Y, 32M, 32C, and 32K are placed into respective locations in the bottle container 31 from above. The yellow, magenta, cyan, and black toner contained in the toner bottles 32Y, 32M, 32C, and 32K, respectively, are appropriately dispensed into the respective developing units of the process cartridges 6Y, 6M, 6C, and 6K by a toner dispensing system described below. Each of the toner bottles 32Y, 32M, 32C, and 32K and the process cartridges 6Y, 6M, 6C, and 6K are independently detachable from the image forming apparatus 100.

Figure 6:
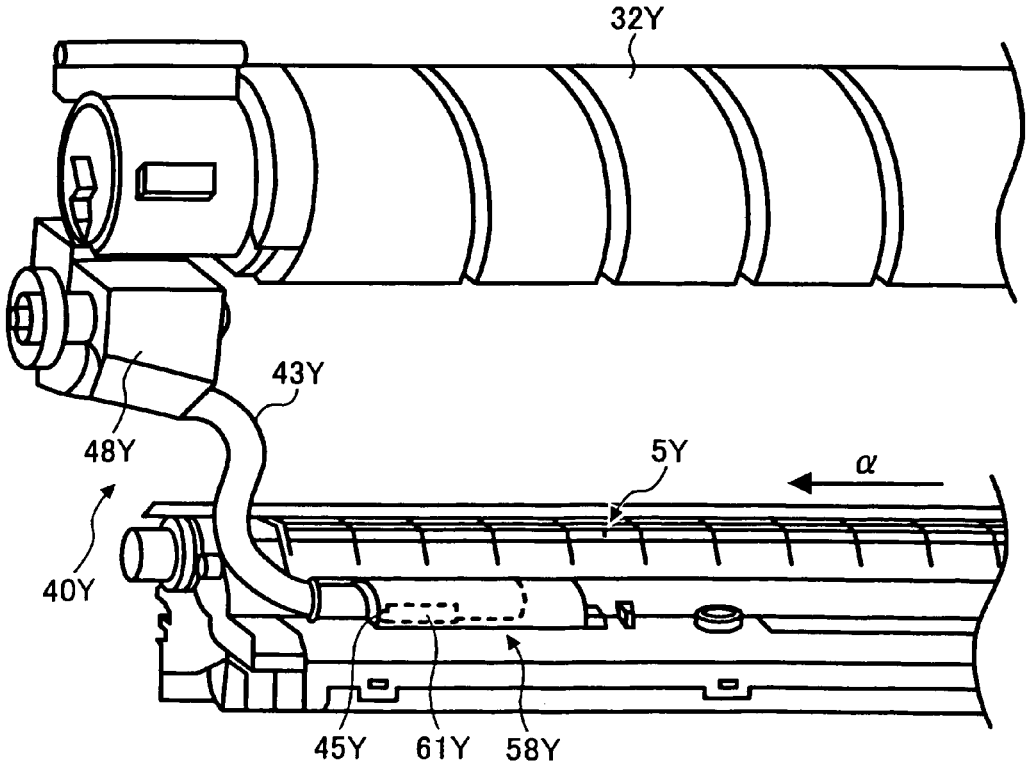
FIG. 6 is a perspective view of a toner dispensing system for dispensing toner from a toner bottle to a developing unit of the process cartridge of FIG. 5.

Referring to FIG. 6, a toner dispensing system 40Y for dispensing toner from the toner bottle 32Y to the developing unit 5Y will be described. FIG. 6 depicts a developing unit 5Y portion of the process cartridge 6Y. In the image forming apparatus 100, the toner dispensing system 40Y is disposed under a position where the toner bottle 32Y is placed.

The toner dispensing system 40Y includes a conveyance pipe 43Y for conveying toner to the developing unit 5Y and a toner hopper portion 48Y. The conveyance pipe 43Y has an opening 45Y. The developing unit 5Y includes, for being dispensed with toner, a toner dispensing portion 58Y and a toner-dispensing hole 61Y.

By sliding the process cartridge 6Y in the direction indicated by an arrow $\alpha$, the process cartridge 6Y is placed into the image forming apparatus 100, and an edge of the conveyance pipe 43Y is engaged with the toner dispensing portion 58Y of the developing unit 5Y. New toner filled in the toner bottle 32Y is first dispensed into the toner hopper portion 48Y of the toner dispensing system 40Y. The toner stored in the toner hopper portion 48Y is dispensed into the developing unit 5Y when a toner density is determined to be low by a toner detection device (not shown) in the developing unit 5Y. The toner in the toner hopper portion 48Y is supplied into the toner-dispensing hole 61Y of the developing unit 5Y through the conveyance pipe 43Y and from the opening 45Y of the conveyance pipe 43Y.

In this manner, the toner and the carriers which serve as the developer are contained in the developing unit 5Y in advance. The toner consumed by development is replenished from the toner bottle 32Y into the developing unit 5Y.

It is to be noted that, although the developing unit 5Y according to the example embodiment uses two-component developer including toner and carriers, a single component developer may also be used.

Figure 7:
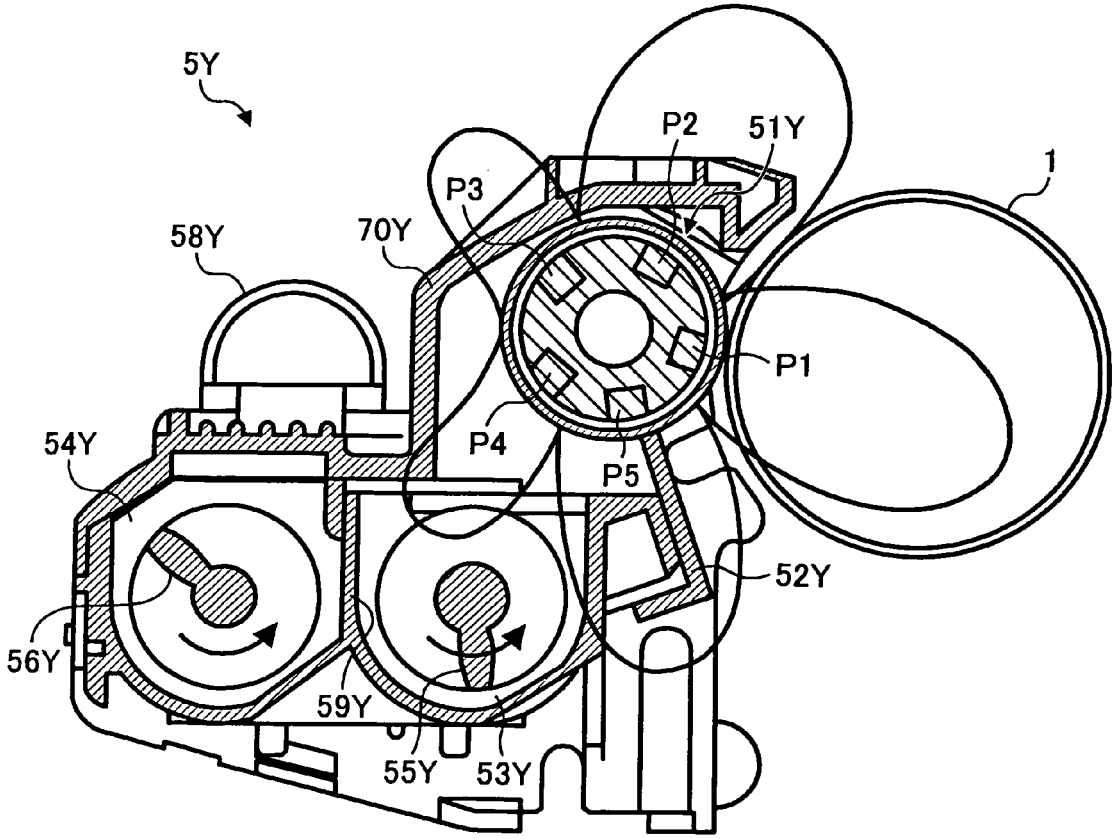
FIG. 7 is an illustration for explaining a configuration of the developing unit.
Figure 8:
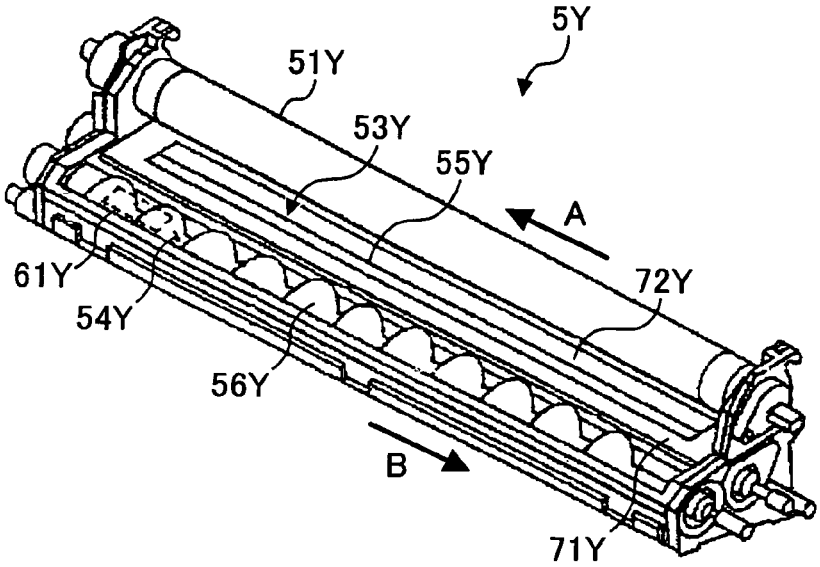
FIG. 8 is a perspective view of the developing unit with a top cover removed.
Figure 9:
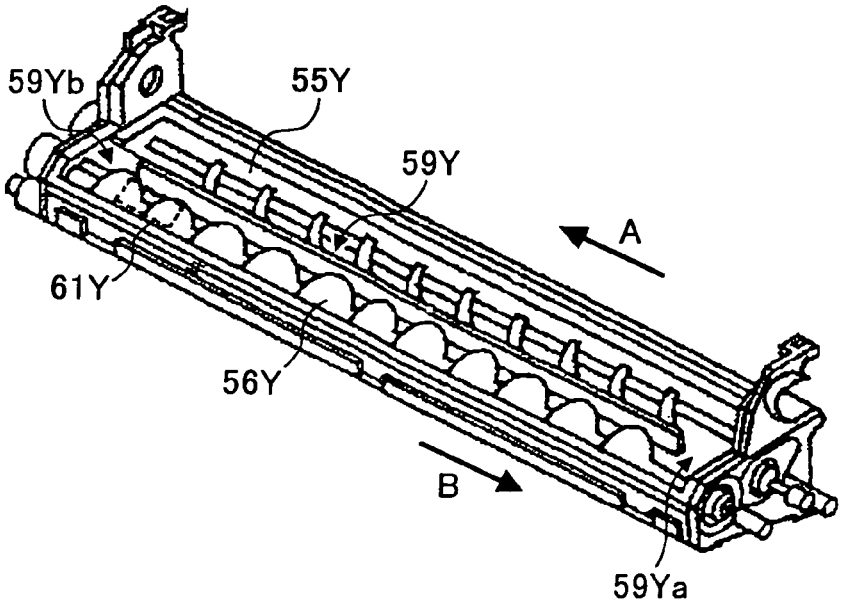
FIG. 9 is a perspective view of the developing unit of FIG. 8 with a development roller and a frame member further removed.

Referring now to FIGS. 7 through 9, the developing unit 5Y in the process cartridge 6Y is described in detail. As illustrated in FIG. 7, the developing unit 5Y includes a development roller 51Y serving as a developer carrying member, a partition 59Y, a first chamber 53Y, a second chamber 54Y, a first screw 55Y serving as a first rotary member, a second screw 56Y serving as a second rotary member, magnets $P_1$, $P_2$, $P_3$, $P_4$, and $P_5$, a doctor blade 52Y, and a top cover 70Y. FIG. 8 is a perspective view of the developing unit 5Y with the top cover 70Y removed. As illustrated in FIG. 8, the developing unit 5Y further includes a frame member 71Y including a communicating hole 72Y. FIG. 9 is a perspective view of the developing unit 5Y similar to FIG. 8 with the development roller 51Y and the frame member 71Y further removed.

Referring to FIG. 7, the development roller 51Y is partly exposed to the outside via an opening of a casing of the developing unit 5Y. The development roller 51Y includes a magnet roller, which is a magnetic field generation device having five magnets $P_1$, $P_2$, $P_3$, $P_4$, and $P_5$, and a developer sleeve rotating coaxially around the magnetic roller.

The magnets $P_3$ and $P_4$ are disposed to generate magnetic fields having a common polarity. Each of the magnets $P_1$, $P_2$, and $P_5$ is disposed to generate a magnetic field having a polarity opposite to a polarity of the adjacent magnets.

The doctor blade 52Y is disposed at a location opposed to a downstream side of the magnet $P_5$ in a surface movement direction of the developer sleeve. The doctor blade 52Y regulates the film thickness of the developer.

Below the development roller 51Y, there is provided an enclosure having an inside space configured to contain the developer, which is divided by the partition 59Y into the first chamber 53Y on a side of the development roller 51Y and the second chamber 54Y. The first chamber 53Y holds a first screw 55Y, and the second chamber 54Y holds the second screw 56Y. Each of the first screw 55Y and the second screw 56Y has a spiral screw shape having an axis portion and a blade portion.

Referring to FIG. 8, between the development roller 51Y and the first screw 55Y, there is provided the frame member 71Y including the communicating hole 72Y through which the developer is supplied to the development roller 51Y.

Referring to FIG. 9, the partition 59Y forms a first opening 59Ya and a second opening 59Yb through which the developer may pass between the first chamber 53Y and the second chamber 54Y.

The manner in which the developer circulates around the first and second chambers 53Y and 54Y is now described. Toner replenished from the toner bottle 32Y is dispensed into the second chamber 54Y of the developing unit 5Y via the toner-dispensing hole 61Y, which is marked in FIGS. 8 and 9 by broken-line boxes. The toner dispensed into the second chamber 54Y is agitated with carriers by the second screw 56Y to form developer. The second screw 56Y conveys and agitates the developer in a direction indicated by an arrow B until the developer reaches the end of the second chamber 54Y. Then the developer passes through the first opening 59Ya to enter the first chamber 53Y. In the first chamber 53Y, the first screw 55Y conveys and agitates the developer in a direction indicated by an arrow A. When the developer reaches the end of the first chamber 53Y, the developer passes through the second opening 59Yb to enter the second chamber 54Y. Thus, the developer is circulated in the developing unit 5Y by the first screw 55Y and the second screw 56Y.

A part of the developer being agitated and conveyed by the first screw 55Y in the first chamber 53Y is attracted by the development roller 51Y so as to be carried on the development roller 51Y. That is, the carriers in the developer is attracted to the development roller 51Y by magnetic force generated by the magnet $P_4$ or $P_5$ of the magnet roller to be carried on the development roller 51Y. Meanwhile, the toner in the developer has been charged with an opposite polarity to the polarity of the carriers by being agitated, generating electrostatic force between the toner and the carriers. Therefore, the toner is carried on the development roller 51Y with the carriers.

Passing through a gap (i.e. doctor gap) between the doctor blade 52Y and the surface of the development roller 51Y regulates the thickness of the developer carried on the development roller 51Y. When the developer of which thickness has been regulated is conveyed to a development area opposed to the photoconductive member 1, a magnetic force generated by the magnet $P_1$ of the magnet roller causes the developer to become erect in a brush-like form. Here, in the development area, the surface of the development roller 51Y has a higher linear velocity than a surface of the photoconductive member 1Y while moving in a same direction. While sliding over the surface of the photoconductive member 1Y, the carriers erecting in a brush-like form on the development roller 51Y supplies the toner adhering to the carriers to the surface of the photoconductive member 1Y.

At this time, a development bias is applied to the development roller 51Y by a power source (not shown) thereby forming a development field in the development area. Electrostatic force is generated between the latent image on the photoconductive member 1Y and the development roller 51Y, which attracts the toner on the development roller 51Y to the latent image. Thereby, the toner on the development roller 51Y adheres to the latent image on the photoconductive member 1Y.

In this manner, the latent images on the respective photoconductive members 1Y, 1M, 1C, and 1K are developed into toner images having respective colors. In addition, the development roller 51Y according to an example embodiment is connected to a driving unit via a clutch (not shown), so that rotation of the development roller 51Y may be temporarily stopped by the clutch.

Figure 10:
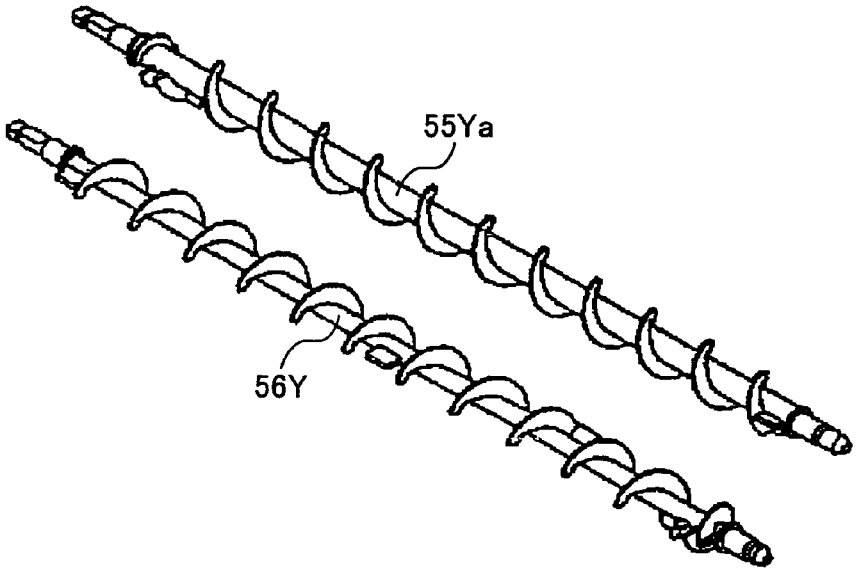
FIG. 10 is a perspective view of a first screw and the second screw used in the developing unit.

Referring now to FIG. 10, a specific description is given of a first screw 55Ya used in the developing unit 5Y according to the example embodiment. As illustrated in FIG. 10, the first screw 55Ya has a bigger axis diameter than the second screw 56Y. With the exception that the first screw 55Ya is bigger in axis diameter, the first screw 55Ya and the second screw 56Y are the same in such respects as a screw pitch of the blade portion and a rotation speed of the screws.

Specifically, the first screw 55Ya preferably has a screw member of 7.0-mm axis diameter, where the second screw 56Y employs a screw member of 5.0-mm axis diameter. The inventors compared four types of axis diameter, 5.0 mm, 6.0 mm, 7.0 mm, and 8.0 mm for the first screw 55Ya. Among the axis diameters, 7.0 mm was most preferable.

It should be noted that the diameter of the second screw 56Y is not limited to 5.0 mm. Generally, the axis diameter ranging from approximately 3 mm to 12 mm is used depending on an amount of the developer to be conveyed. Thus, a preferable range of the axis diameter of the first screw 55Ya, which is bigger than the second screw 56Y, may change accordingly.

Figure 11:
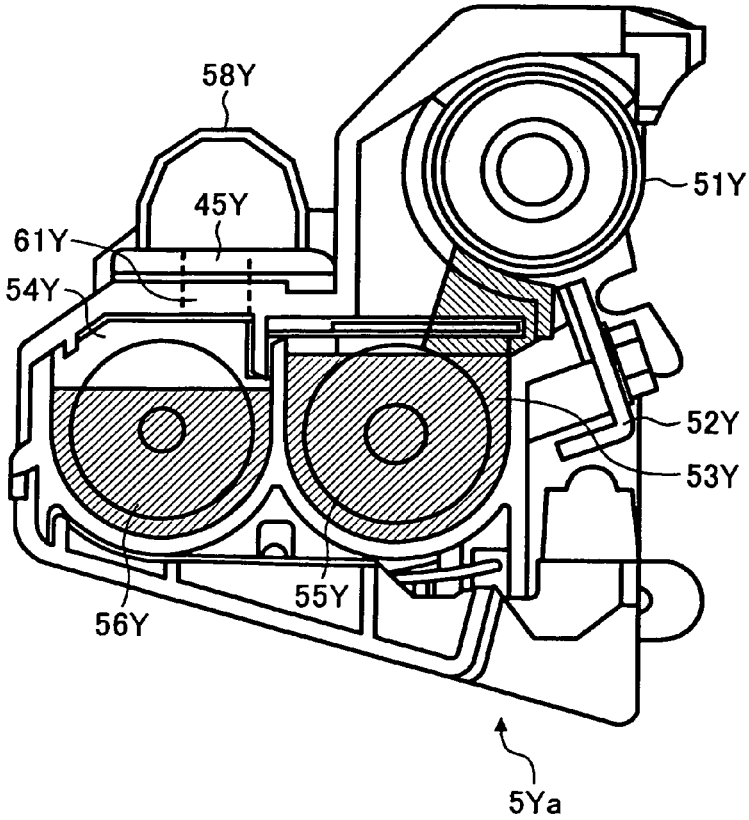
FIG. 11 is an illustration of the developing unit in a state that developer in a first chamber has a higher surface than developer in a second chamber.

FIG. 11 illustrates a developing unit 5Ya using the first screw 55Ya. When the first screw 55Ya has a bigger axis diameter than the second screw 56Y, the first screw 55Ya has a larger volume than the second screw 56Y. Thus, the first chamber 53Y has a smaller developer-containing space than the second chamber 54Y. Therefore, as illustrated in FIG. 11, the height surface of the developer in the first chamber 53Y becomes higher than a surface of the developer in the second chamber 54Y.

It should be noted that, at a point when the developing unit 5Ya is placed into the image forming apparatus 100, the height of the surfaces of the developer in the first chamber 53Y and second chamber 54Y are at substantially same level.

Here, the first chamber 53Y has a smaller amount of the developer than the second chamber 54Y. Since the first screw 55Ya has a bigger axis diameter than the second screw 56Y (i.e. the first screw 55Ya has a larger volume than the second screw 56Y), the first chamber 53Y has a smaller developer-containing space than the second chamber 54Y.

While the height of the surfaces of the developer in the first chamber 53Y and second chamber 54Y are at substantially the same level, the amount of developer passing through the first opening 59Ya is larger than an amount of the developer passing through the second opening 59Yb, thus increasing the amount of the developer in the first chamber 53Y. Therefore, the surface of the developer in the first chamber 53Y becomes higher, thus increasing the amount of the developer passing through the second opening 59Yb.

Once the amounts of the developer passing through the first opening 59Ya and the second opening 59Yb per time unit become substantially equal, the amount of the developer is stabilized in a state that the first chamber 53Y has a higher surface than the second chamber 54Y as illustrated in FIG. 11.

Figure 3:
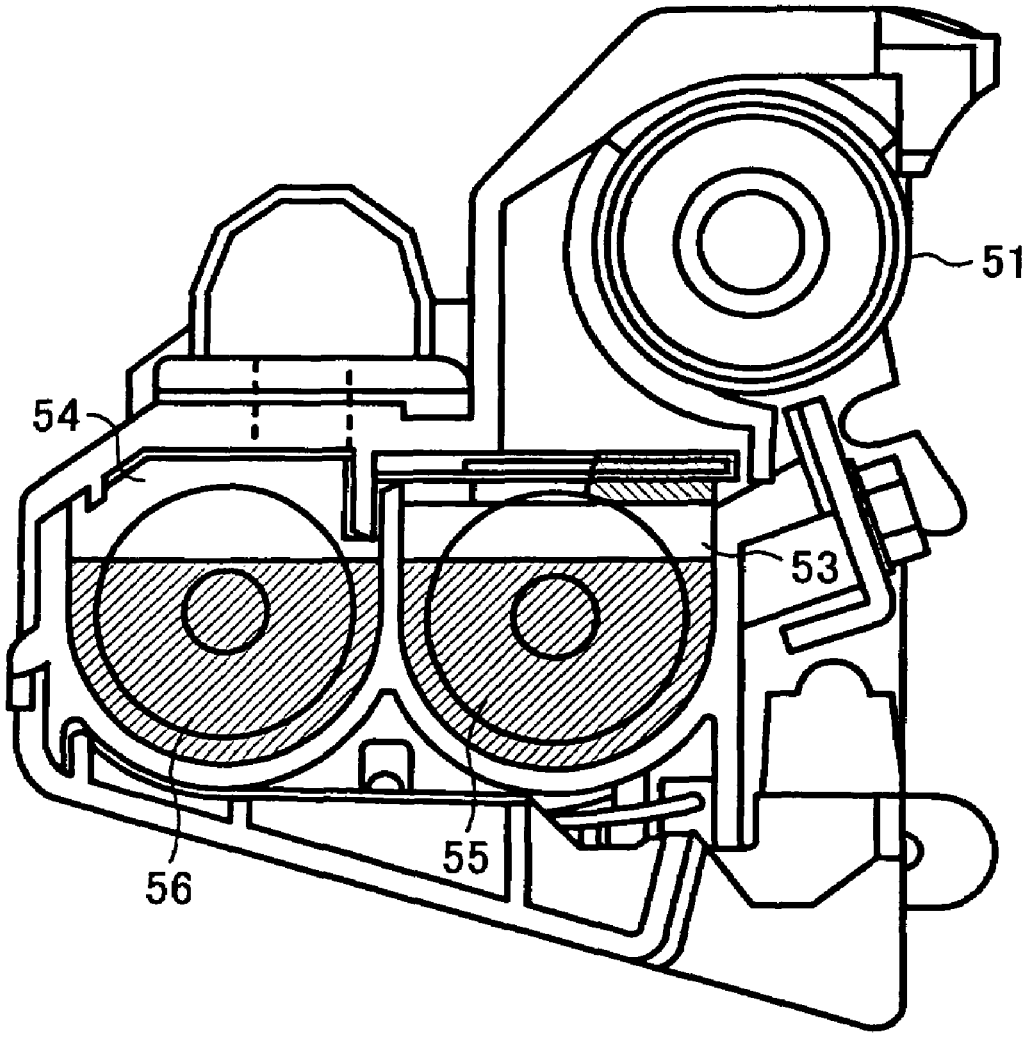
FIG. 3 BACKGROUND ART
FIG. 3 is a cross-sectional view of the developing unit of FIG. 1 in a state where both of the first chamber and the second chamber have a relatively low level of developer.

Compared to the background examples described with reference to FIGS. 1 and 3, even when the developer is filled to the top portion of the first chamber 53Y, the developer is not to be filled to the top portion of the second chamber 54Y.

When there is a big difference between the amounts of the developer to be conveyed by the first screw 55Y and by the second screw 56Y, the developer may sometimes accumulate in the vicinity of where the first screw 55Y starts to convey the developer, that is, the first opening 59Ya.

As a result, the surface of the developer may become temporarily high at an edge portion of the developing unit 5Ya, causing the developer to slip into a gap between the edge portion of the development roller 51Y and a casing member of the developing unit 5Ya, so that the developer may stop the rotation of the development roller 51Y or leak to the outside.

However, the developing unit 5Ya according to the embodiment is provided with the frame member 71Y including the communicating hole 72Y, thus covering an upper portion of the first opening 59Ya. Therefore, even when the amount or height of the developer is temporarily increased at the edge portion of the developing unit 5Ya, the developer may be prevented from reaching the edge portion of the development roller 51Y.

Figure 12:
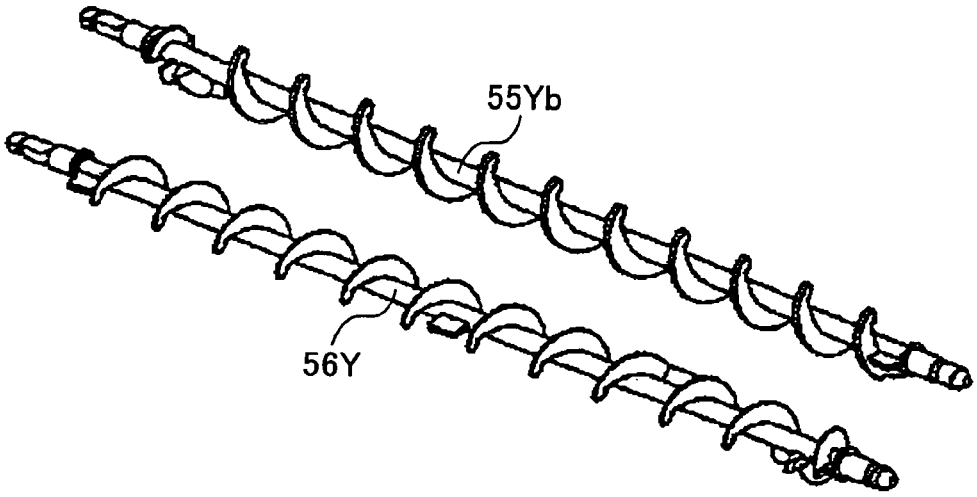
FIGS. 12 and 13 are perspective views of pairs of a first screw and the second screw used in the developing unit of FIG. 11 according to different example embodiments.
Figure 13:
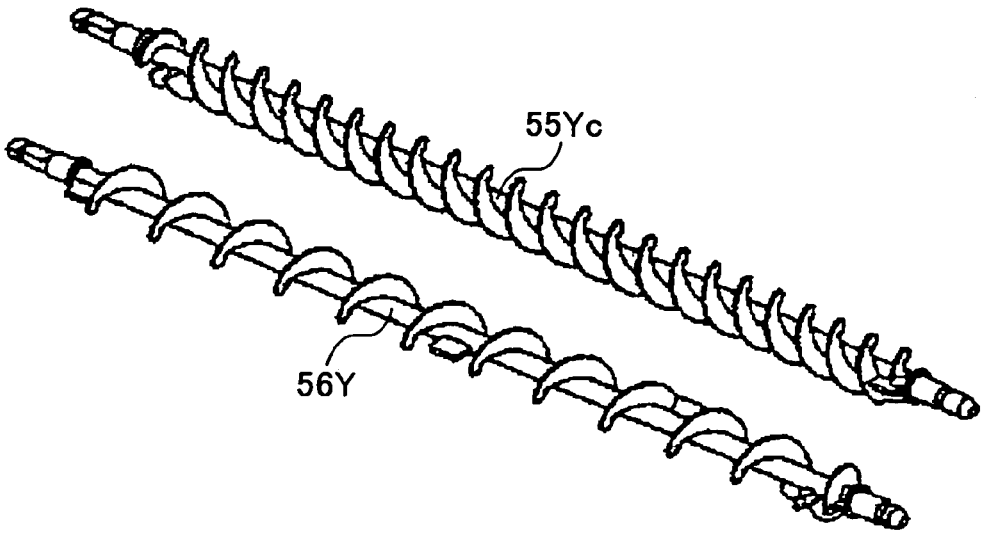
Figure 14:
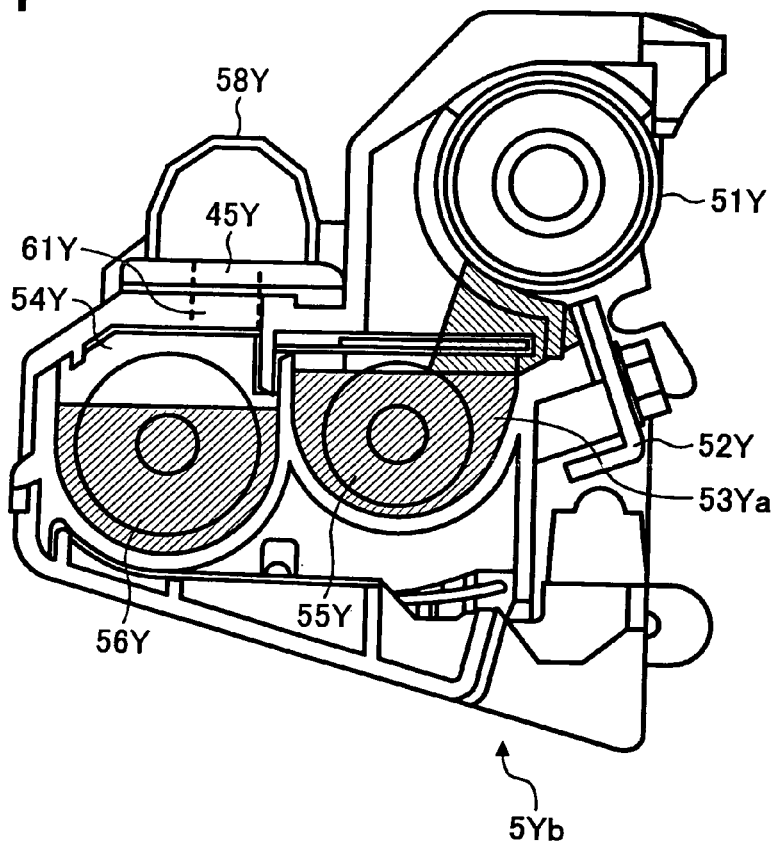
FIG. 14 is a cross-sectional view of a developing unit according to another example embodiment.

Referring now to FIGS. 12 through 14, the developing unit 5Ya according to different example embodiments are described.

In the following example embodiments, some components of the developing unit 5Ya in the image forming apparatus 100 such as a shape of the first screw 55Y may be different; however, the basic configuration of the image forming apparatus 100 may be substantially equal. Following descriptions are focused on matters different from the above example embodiments, and matters in common with the above example embodiments are to be omitted.

As illustrated in FIG. 12, a first screw 55Yb used in the image forming apparatus 100 according to another example embodiment has a blade portion thicker than the second screw 56Y. Except for the thickness of the blade portion, the first screw 55Yb and the second screw 56Y have substantially similar shapes in such respects as axis diameter, and pitch of the blade portion.

When the first screw 55Yb has a thicker blade portion than the second screw 56Y, the first screw 55Yb has a larger volume than the second screw 56Y. As a result, the first chamber 53Y has a smaller developer-containing space than the second chamber 54Y. Therefore, in the image forming apparatus 100 having the first screw 55Yb, the developer in the first chamber 53Y has a higher surface than the second chamber 54Y as illustrated in FIG. 11.

As illustrated in FIG. 13, a blade portion of a first screw 55Yc used in the image forming apparatus 100 according to another example embodiment has more blades than a blade portion of the second screw 56Y.

When the first screw 55Yc has more blades in the blade portion than the second screw 56Y, the first screw 55Yc has a larger volume than the second screw 56Y. As a result, the first chamber 53Y has a smaller developer-containing space than the second chamber 54Y. Therefore, in the image forming apparatus 100 having the first screw 55Yc, the developer in the first chamber 53Y has a higher surface than the second chamber 54Y as illustrated in FIG. 11.

Specifically, the first screw 55Yc preferably has two spiral blades where the second screw 56Y has one spiral blade around each axis portion. Except for the number of blades, the first screw 55Yc and the second screw 56Y have substantially similar shapes in such respects as an axis diameter, a pitch of the blade portion, and a thickness of the blade portion.

Each of the first screws 55Ya, 55Yb, and 55Yc described with reference to FIGS. 10, 12, and 13 may have a higher strength due to its larger volume. Further, each of the first screw 55Ya, 55Yb, and 55Yc has a larger cross-sectional area than a conventional first screw. Generally, a screw having a large cross-sectional area is less subject to a run-out caused by rotation.

FIG. 14 illustrates a developing unit 5Yb of the image forming apparatus 100 according to another example embodiment. As illustrated in FIG. 14, the first chamber 53Ya has a smaller volume, that is, a smaller developer-containing space, than the second chamber 54Y. Therefore, in the image forming apparatus 100 having the first chamber 53Ya, the developer in the first chamber 53Y has a higher surface than the second chamber 54Y, in a similar manner to the developing unit 5Ya having the first screws 55Ya, 55Yb, and 55Yc.

Referring now to FIGS. 15 to 18, descriptions are given on the image forming apparatus 100 according to different example embodiments. In the following example embodiments, the developer in the first chamber 53Y moves slower than the developer in the second chamber 54Y so that the developer in the first chamber 53Y has a higher surface than the second chamber 54Y.

Figure 15:
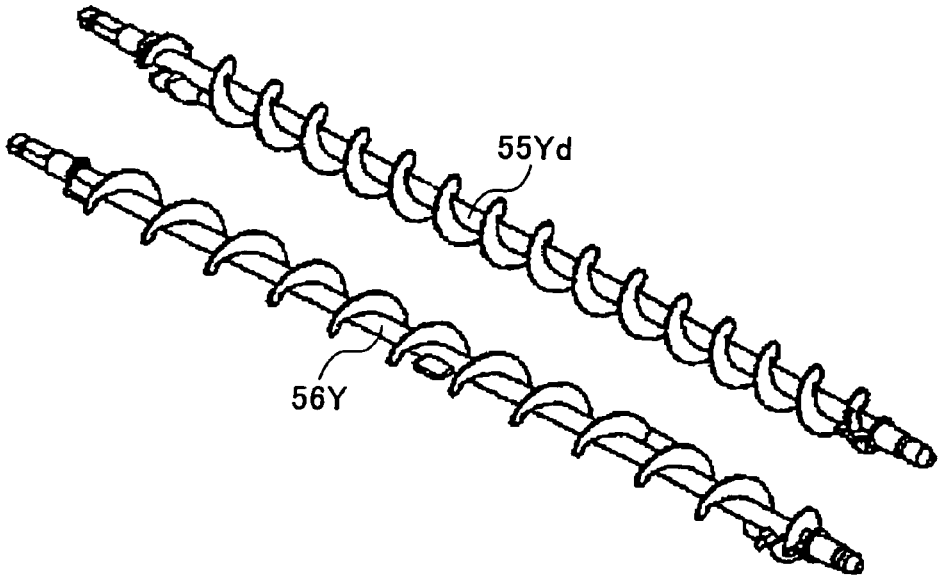
FIGS. 15, 16, and 17 are perspective views of pairs of a first screw and the second screws used in the developing unit 10 according to different example embodiment.

Referring to FIG. 15, a first screw 55Yd used in the image forming apparatus 100 according to another example embodiment has a smaller screw pitch in a blade portion than the second screw 56Y. A smaller screw pitch may reduce a distance for which the developer is conveyed by one rotation of the first screw 55Yd.

Assuming that the first screw 55Yd and the second screw 56Y have the same rotational speed, the first screw 55Yd has a lower conveying speed than the second screw 56Y. That is, the developer in the first chamber 53Y moves slower than the developer in the second chamber 54Y.

At a point when the developing unit 5Ya having the first screw 55Yd is placed into the image forming apparatus 100, the height of the surfaces and amounts of the developers in the first chamber 53Y and second chamber 54Y are at substantially same level. When the developing unit 5Ya is driven at this state, since the conveying speed of the first screw 55Yd is lower than the conveying speed of the second screw 56Y, the amount of the developer passing through the first opening 59Ya becomes larger than an amount of the developer passing through the second opening 59Yb, thus increasing the amount of the developer in the first chamber 53Y. When the amount of the developer in the first chamber 53Y increases, the surface of the developer in the first chamber 53Y becomes higher, thus increasing the amount of the developer passing through the second opening 59Yb per time unit.

When more developer passes through the first opening 59Ya than the second opening 59Yb, the developer in the second chamber 54Y decreases, so that the amount of the developer passing through the first opening 59Ya per time unit is decreased.

Once the amount of developer passing through the first opening 59Ya and the second opening 59Yb per time unit become substantially equal, the amount of the developer is stabilized in a state that the first chamber 53Y has a higher surface than the second chamber 54Y as illustrated in FIG. 11.

As described, since the conveying speed of the first screw 55Yd is lower than the conveying speed of the second screw 56Y, the developer in the first chamber 53Y may have a higher surface than the developer in the second chamber 54Y as illustrated in FIG. 11. Even when the developer is filled to the top portion of the first chamber 53Y, the developer is not to be filled to the top portion of the second chamber 54Y.

Figure 16:
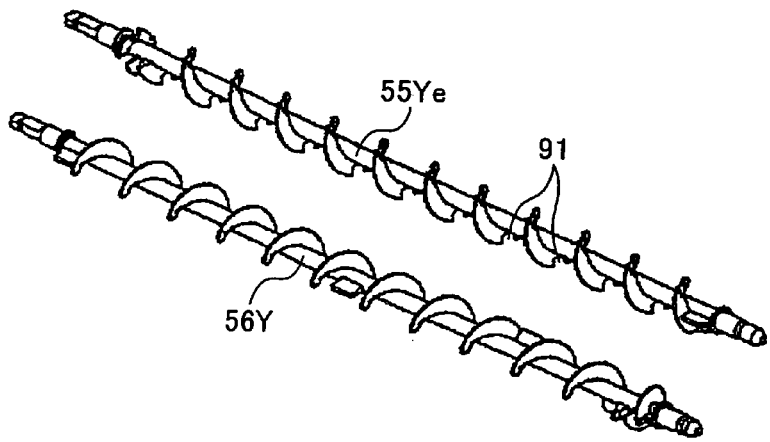

FIG. 16 illustrates a first screw 55Ye and the second screw 56Y used in the image forming apparatus 100 according to another example embodiment. As illustrated in FIG. 16, the first screw 55Ye has a notch 91 in a blade portion. Provision of the notch on the first screw 55Ye causes a part of the developer, which is to be pressed by the blade portion and conveyed to an axial direction as the first screw 55Ye rotates, to escape through the notch 91, thus reducing a conveyance efficiency.

Assuming that the first screw 55Ye and the second screw 56Y have a same rotational speed, the first screw 55Ye has a lower conveying speed than the second screw 56Y. That is, the developer in the first chamber 53Y moves slower than the developer in the second chamber 54Y. Therefore, in the image forming apparatus 100 having the first screw 55Ye, the developer in the first chamber 53Y may have a higher surface than the developer in the second chamber 54Y as illustrated in FIG. 11.

Figure 17:
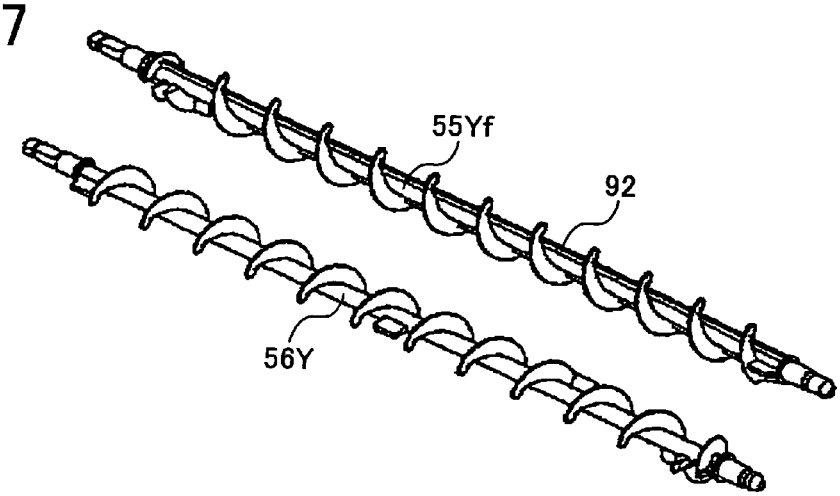

FIG. 17 illustrates a first screw 55Yf and a second screw 56Y used in the image forming apparatus 100 according to another example embodiment. As illustrated in FIG. 17, the first screw 55Yf has a rib 92 as a plate member parallel in axial direction to the axis member of the first screw 55Yf. By providing the rib 92 on the first screw 55Yf, the developer, which is to be pressed by the blade portion and conveyed to an axial direction as the first screw 55Yf rotates, is subjected to a force moving in a rotation direction, thereby reducing conveyance efficiency in the axial direction.

Assuming that the first screw 55Yf and the second screw 56Y have a same rotational speed, the first screw 55Yf has a lower conveying speed than the second screw 56Y. That is, the developer in the first chamber 53Y moves slower than the developer in the second chamber 54Y. Therefore, in the image forming apparatus 100 having the first screw 55Yf, the developer in the first chamber 53Y may have a higher surface than the developer in the second chamber 54Y as illustrated in FIG. 11.

Since each of the first screws 55Yd, 55Ye, and 55Yf used in the image forming apparatus 100 as described with reference to FIGS. 15 to 17 has a relatively low conveying speed, load applied thereon may be reduced even when the first chamber 53Y is filled with the developer to the top portion.

Further, the first screws 55Yd and 55Yf in FIG. 15 and FIG. 17 not only have a lower conveying speed but also may have a larger volume than the respective second screws 56Y. Therefore, the image forming apparatus 100 including the first screw 55Yd or 55Yf may have a effect similar to the image forming apparatus 100 including any one of the first screws 55Ya, 55Yb, and 55Yc described with reference to FIGS. 10, 12, and 13.

Figure 18:
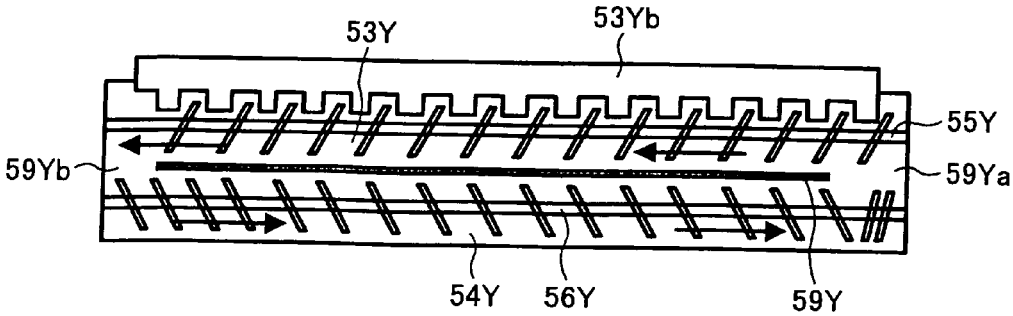
FIG. 18 is a cross-sectional top view of a developing unit according to another example embodiment.

FIG. 18 is a cross-sectional top view of the developing unit 5Ya of the image forming apparatus 100 according to another example embodiment. As illustrated in FIG. 18, the first chamber 53Y includes a conveyance inhibiting member 53Yb for inhibiting conveyance of the developer.

The conveyance inhibiting member 53Yb is a soft film member formed of resin such as polyethylene. Since the conveyance inhibiting member 53Yb is soft and easily deformed, even when contacting the first screw 55Y, the conveyance inhibiting member 53Yb becomes easily deformed and does not inhibit rotation of the first screw 55Y.

The conveyance inhibiting member 53Yb may inhibit movement of the developer particles to some extent, thereby reducing the conveyance efficiency of the developer.

Assuming that the first screw 55Y and the second screw 56Y have the same rotational speed, the first screw 55Y has a lower conveying speed than the second screw 56Y. That is, the developer in the first chamber 53Y moves slower than the developer in the second chamber 54Y. Therefore, in the image forming apparatus 100 having the conveyance inhibiting member 53Yb, the developer in the first chamber 53Y may have a higher surface than the developer in the second chamber 54Y as illustrated in FIG. 11.

In the image forming apparatus 100 including the first screw 55Yd, 55Ye, and 55Yf and conveyance inhibiting member 53Yb described with reference to FIGS. 15 through 18, the developer in the first chamber 53Y moves slower than the developer in the second chamber 54Y. Therefore, the surface of the developer in the first chamber 53Y, which supplies the developer to the development roller 51Y, becomes higher than the surface of the developer in the second chamber 54Y, into which toner is dispensed from an upper portion.

A configuration in which the developer in the first chamber 53Y moves slower than the developer in the second chamber 54Y may also be achieved by lowering a rotation speed of the first screw 55Y than the second screw 56Y.

Lowering the rotational speed of the first screw 55Y may be achieved differently depending on a configuration of a driving portion (not shown) for the first screw 55Y and the second screw 56Y: when the first screw 55Y and the second screw 56Y are driven by one motor, gear ratios of the first and second screws 55Y and 56Y are to be changed; and when the first screw 55Y and second screw 56Y are driven by individual motors, number of revolutions of a drive source for the first screw 55Y is to be reduced. In both cases, the first screw 55Y and the second screw 56Y are substantially same except that the rotation speed of the first screw 55Y is slower than the second screw 56Y.

When the first screw 55Y has a lower rotation speed than the second screw 56Y, the first screw 55Y may have a lower conveying speed than the second screw 56Y. Accordingly, the image forming apparatus 100 in which the first screw 55Y has a lower rotation speed than the second screw 56Y may have effects similar to that of the image forming apparatus 100 including the first screw 55Yd, 55Ye, and 55Yf and the conveyance inhibiting member 53Yb described with reference to FIGS. 15 through 18.

It should be noted that, although the developing units 5Ya and 5Yb using yellow toner have been described above, configurations of the developing unit 5Ya and 5Yb discussed above may also be applied to the developing unit 5M, 5C, and 5K.

In principle, the difference between the surfaces of the developer may be caused by a difference in a developer-containing space or a difference in a developer-conveying speed between the first chamber 53Y and the second chamber 54Y.

Numerous additional modifications and variations are possible in light of the above teachings. For example, the image forming apparatus 100 may employ as a rotary member a conveyance coil formed of resin, metal, and other materials instead of the conveyance screws.

When the image forming apparatus 100 uses conveyance coils, a conveyance coil, which corresponds to the first screw, having configurations similar to any one of the first screw 55Ya, 55Yb, 55Yc, 55Yd, 55Ye, and 55Yf may be used. For example, the conveyance coil may have a thick wire diameter, a relatively low rotation speed leading to a low conveying speed, a smaller coil pitch, and a thick core if the conveyance coil has a core formed by solder brazing, etc.

When the image forming apparatus 100 includes such a conveyance coil, developer in the first chamber 53Y may have a higher surface than developer in the second chamber 54Y in a similar manner to the image forming apparatus 100 having configurations described with reference to FIGS. 10 through 18.

It is therefore to be understood that within the scope of the appended claims, the disclosure of this patent specification may be practiced otherwise than as specifically described herein.

This patent specification is based on Japanese patent applications, No. JPAP 2005-250836 filed on Aug. 31, 2005 and No. 2004-341895 filed on Nov. 26, 2004, in the Japanese Patent Office, the entire contents of which are incorporated by reference herein.

What is claimed is:

1. An image forming apparatus comprising:

a developer carrying member configured to carry developer;

first and second rotary members arranged parallel to each other and configured to rotate to agitate and convey the developer; and an enclosure having an inside space to contain the developer, the inside space being divided by a partition with communication openings formed therein at opposite ends thereof into a first chamber, said first rotary member being positioned in said first chamber and being configured to maintain the developer above a first level in said first chamber and to supply the developer to the developer carrying member while agitating and conveying the developer, and a second chamber, said second rotary member being positioned in said second chamber and being configured to communicate developer from said second chamber to the first chamber through at least one of the communication openings, and to maintain the developer at a second level in said second chamber lower than the first level, the second rotary member circulating the developer from the first chamber through at least another one of the communication openings wherein said first rotary member has a shaft diameter which is greater than that of said second rotary member and is substantially constant throughout a length portion thereof, an outer diameter of said first rotary member being substantially constant throughout a length portion thereof and being substantially equal to that of said second rotary member, wherein a new developer is supplied to said second chamber.

2. The image forming apparatus of claim 1, wherein the first rotary member has a larger volume than the second rotary member.

3. The image forming apparatus of claim 2, wherein each of the first rotary member and the second rotary member includes an axis portion and a blade portion, and the first rotary member has a larger axis diameter than the second rotary member.

4. A developing unit as claimed in claim 1, wherein a pitch angle of said first and second rotary shafts is substantially equal, said pitch angle being substantially constant throughout the length portion of said first and second shafts.

5. A process cartridge comprising:

a developer carrying member configured to carry developer;

first and second rotary members arranged in parallel to each other and configured to rotate to agitate and convey the developer; and an enclosure having an inside space to contain the developer, the inside space being divided by a partition with communication openings formed therein at opposite ends thereof into a first chamber, said first rotary member being positioned in said chamber and being configured to maintain the developer above a first level in said first chamber and to supply the developer to the developer carrying member while agitating and conveying the developer, and a second chamber, said second rotary member being positioned in said second chamber and being configured to communicate developer from said second chamber to the first chamber through at least one of the communication openings, and to maintain the developer at a second level in said second chamber lower than the first level, the second rotary member circulating the developer from the first chamber through at least another one of the communication openings wherein said first rotary member has a shaft diameter which is greater than that of said second rotary member and is substantially constant throughout a length portion thereof, an outer diameter of said first rotary member being substantially constant throughout a length portion thereof and being substantially equal to that of said second rotary member, wherein a new developer is supplied to said second chamber.

6. A developing unit as claimed in claim 5, wherein a pitch angle of said first and second rotary shafts is substantially equal, said pitch angle being substantially constant throughout the length portion of said first and second shafts.

7. A developing unit comprising:

a developer carrying member configured to carry developer;

first and second rotary members arranged in parallel to each other and configured to rotate to agitate and convey the developer; and an enclosure having an inside space to contain the developer, the inside space being divided by a partition with communication openings formed therein at opposite ends thereof into a first chamber, said first rotary member being positioned in said chamber and being configured to maintain the developer above a first level in said first chamber and to supply the developer to the developer carrying member while agitating and conveying the developer, and a second chamber, said second rotary member being positioned in said second chamber and being configured to communicate developer from said second chamber to the first chamber through at least one of the communication openings, and to maintain the developer at a second level in said second chamber lower than the first level, the second rotary member circulating the developer from the first chamber through at least another one of the communication openings wherein said first rotary member has a shaft diameter which is greater than that of said second rotary member and is substantially constant throughout a length portion thereof, an outer diameter of said first rotary member being substantially constant throughout a length portion thereof and being substantially equal to that of said second rotary member, wherein a new developer is supplied to said second chamber.

8. A developing unit as claimed in claim 7, wherein a pitch angle of said first and second rotary shafts is substantially equal, said pitch angle being substantially constant throughout the length portion of said first and second shafts.

9. An image forming apparatus comprising:

a developer carrying member configured to carry developer;

first and second rotary members arranged parallel to each other and configured to rotate to agitate and convey the developer; and an enclosure having an inside space to contain the developer, the inside space being divided by a partition with communication openings formed therein at opposite ends thereof into a first chamber, said first rotary member being positioned in said first chamber and being configured to supply the developer to the developer carrying member while agitating and conveying the developer, and a second chamber, said second rotary member being positioned in said second chamber and being configured to communicate developer from said second chamber to the first chamber through at least one of the communication openings, the second rotary member circulating the developer from the first chamber through at least another one of the communication openings wherein said first rotary member has a shaft diameter which is greater than that of said second rotary member and is substantially constant throughout a length portion thereof, the developer from the developer carrying member is collected in the first chamber and wherein an outer diameter of said first rotary member is substantially constant throughout a length portion thereof and is substantially equal to that of said second rotary member, wherein a new developer is supplied to said second chamber.

10. A developing unit as claimed in claim 9, wherein a pitch angle of said first and second rotary shafts is substantially equal and is substantially constant throughout the length portion thereof of said second chamber.

11. A developing unit comprising:

a developer carrying member configured to carry developer;

first and second rotary members arranged parallel to each other and configured to rotate to agitate and convey the developer; and an enclosure, containing the developer, comprising:

an inside space to contain the developer;

a partition dividing the inside space;

communication openings formed in the enclosure at opposite ends of the partition;

a first chamber formed by the enclosure and the partition; and a second chamber formed by the enclosure and the partition, the first chamber communicating with the second chamber through the openings, the first rotary member being positioned in the first chamber, the second rotary member being positioned in the second chamber, the first rotary member being configured to maintain the developer above a first level in the first chamber, to supply the developer to the developer carrying member, and to convey the developer in the first chamber to the second chamber through at least one of the openings, the second rotary member being configured to maintain the developer below a second level in the second chamber, and to convey the developer in the second chamber to the first chamber through at least another one of the openings, and the second level being lower than the first level, wherein the first rotary member has a larger volume than that of the second rotary member, a new developer is supplied to the second chamber from a toner cartridge, each of said first rotary member and second rotary member includes an axis portion and a blade portion, and the first rotary member has a larger axis diameter than the second rotary member.

12. An image forming apparatus comprising the development unit claimed in claim 11.

13. A developing unit comprising:

a developer carrying member configured to carry developer;

first and second rotary members arranged parallel to each other and configured to rotate to agitate and convey the developer; and an enclosure, containing the developer, comprising:

an inside space to contain the developer;

a partition dividing the inside space;

communication openings formed in the enclosure at opposite ends of the partition;

a first chamber formed by the enclosure and the partition; and a second chamber formed by the enclosure and the partition, the first chamber communicating with the second chamber through the openings, the first rotary member being positioned in the first chamber, the second rotary member being positioned in the second chamber, the first rotary member being configured to supply the developer to the developer carrying member, and to convey the developer in the first chamber to the second chamber through at least one of the openings, the second rotary member being configured to convey the developer in the second chamber to the first chamber through at least another one of the openings, wherein the first rotary member has a larger volume than that of the second rotary member, a new developer is supplied to the second chamber from a toner cartridge, each of said first rotary member and second rotary member includes an axis portion and a blade portion, and the first rotary member has a larger axis diameter than the second rotary member.

14. An image forming apparatus comprising the development unit claimed in claim 13.

15. A developing unit as claimed in claim 13, wherein a pitch angle of said first and second rotary shafts is substantially equal, said pitch angle being substantially constant throughout the length portion of said first and second shafts.

16. A developing unit as claimed in claim 13, wherein said secondary rotary member has a projection extending therefrom.

17. A developing unit as claimed in claim 13, said developer carrying member further comprising a doctor blade which extends from a bottom part or lower part of said developer carrying member.

* * * * *